US008342647B2

(12) United States Patent
Yamane et al.

(10) Patent No.: US 8,342,647 B2
(45) Date of Patent: Jan. 1, 2013

(54) INKJET PRINTING APPARATUS

(75) Inventors: Toru Yamane, Yokohama (JP); Yukuo Yamaguchi, Tokyo (JP); Mikiya Umeyama, Tokyo (JP); Kiyomitsu Kudo, Machida (JP); Chiaki Muraoka, Kawaguchi (JP); Ken Tsuchii, Sagamihara (JP); Shuichi Ide, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 301 days.

(21) Appl. No.: 12/787,876

(22) Filed: May 26, 2010

(65) Prior Publication Data

US 2010/0315466 A1 Dec. 16, 2010

(30) Foreign Application Priority Data

Jun. 10, 2009 (JP) ..... 2009-139535

(51) Int. Cl.
*B41J 2/21* (2006.01)

(52) U.S. Cl. ..... 347/43; 347/6; 347/95

(58) Field of Classification Search ..... 347/15, 347/40, 43, 84–86, 89–92, 99–100
See application file for complete search history.

(56) References Cited

U.S. PATENT DOCUMENTS

| | | | | |
|---|---|---|---|---|
| 4,528,576 | A * | 7/1985 | Koumura et al. | 347/15 |
| 5,371,531 | A * | 12/1994 | Rezanka et al. | 347/43 |
| 6,467,896 | B2 * | 10/2002 | Meyer et al. | 347/101 |
| 7,553,007 | B2 * | 6/2009 | Hattori et al. | 347/86 |

FOREIGN PATENT DOCUMENTS

JP 07-112534 5/1995

* cited by examiner

*Primary Examiner* — Thinh Nguyen
(74) *Attorney, Agent, or Firm* — Fitzpatrick, Cella, Harper & Scinto

(57) ABSTRACT

An inkjet printing apparatus is provided which can print images with no print quality variations. For this purpose, the fluid viscosity resistances between the print head and the print medium beneath respective nozzle arrays that occur as the print head moves in the forward direction are made equal to those that occur as the print head moves in the backward direction.

8 Claims, 17 Drawing Sheets

INKJET PRINTING APPARATUS

BACKGROUND OF THE INVENTION

1. Field of the Invention

The present invention relates to an inkjet printing apparatus that performs printing by externally applying an energy to ink to eject it onto the print medium.

2. Description of the Related Art

There is a growing need in recent years for the inkjet printing apparatus to stably eject smaller ink droplets precisely in a desired direction in order to realize a faster printing of highly defined images. A popular method currently available to meet this requirement uses a print head mounted in a carriage and having arrays of nozzles with smaller orifices and causes the print head to eject ink from the orifices as it is scanned over a print medium at high speed in a forward and a backward direction. When the printing operation is performed in both directions—forward and backward—printed images may have variations in color because the forward and backward direction printing have the opposite carriage movements or more precisely the order in which different color inks land on the print medium is reversed between the forward and backward direction printing.

FIG. 15A and FIG. 15B show a conventional print head, FIG. 15A being a front view and FIG. 15B a side view. A method has been known which arranges laterally symmetrically nozzle arrays for ejecting magenta and cyan inks to prevent color differences from appearing during printing. This print head can have the same order of color ink landing no matter in which direction—forward and backward—the print head is moving, thus minimizing color differences that would otherwise be caused by a difference in the color ink landing order. As a result, the aforementioned color difference is prevented from appearing even if an image is formed with an odd number of passes. (Japanese Patent Laid-Open No. H7-112534 (1995)).

The print head shown in FIG. 15A has a black chip 010, which is longer than a color chip 011, arranged by the side of the color chip 011 to improve throughput when printing a document with only a black ink. A printing method using such a print head has been known which chooses from among three print modes—one using only the black chip 010, one using only the color chip 011 and one using both of them—according to the kind of material to be printed.

However, although the nozzle arrays in the color chip 011 are arranged symmetrical in the chip in the forward and backward directions, the positioning of the black chip 010, which is placed on only one side of the color chip 011, makes the print head as a whole unsymmetrical in the forward and backward directions. So, the state of air currents flowing between the inkjet print head 014 and the print medium 013 during the printing operation differs between the forward direction printing and the backward direction printing. Therefore, even if the nozzle arrays of the same ink colors are arranged laterally symmetrical as shown in FIG. 15A, the landing positions of main droplets and satellites differ between the forward direction printing and the backward direction printing, causing unevenness in the printed state of an image on the print medium, degrading the image quality. This will be detailed in the following.

FIG. 16A to FIG. 16D show the states of air currents produced between the print head 014 and the print medium 013 during the forward direction printing. The state of air current when the print head 014 is scanned in the forward direction is shown in FIG. 16A and FIG. 16B; and the state of air current when the print head is scanned in the backward direction is shown in FIG. 16C and FIG. 16D. FIG. 16A to FIG. 16D schematically show air current velocity distributions 060 between the print head 014 and the print medium 013. Either in the forward and backward direction, it is seen that the velocity of air currents flowing from the front beneath the nozzle array in the rear is slower than that beneath the nozzle array in front with respect to the direction of carriage movement. This is because the air that has flown in between the print head 014 and the print medium 013 escapes from both sides of the print head 014 as it travels downstream in the direction of its movement, as shown in FIG. 16B and FIG. 16D.

FIG. 17A and FIG. 17B show main droplets and satellites that have landed on the print medium 013, FIG. 17A schematically representing the landing positions during the forward direction printing and FIG. 17B the landing positions during the backward direction printing. Whether the print head is moving in the forward or backward direction, the satellite 022 has a slower ejection speed than the main droplet, so that the satellite 022 lands on the print medium at a position beyond that of the main droplet with respect to the direction of movement of the print head. However, the distance a1 between the main droplet 021 and the satellite 022 of an ink droplet ejected from a nozzle array in the rear with respect to the direction of movement of the print head is greater than the distance b1 between the main droplet 021 and the satellite 022 of an ink droplet ejected from a nozzle array in front because the velocity of air currents flowing from the front beneath the rear nozzle array is slower than that beneath the front nozzle array.

The satellite 022 with a slower ejection speed than that of the main droplet 021 is pushed backward while flying by an air current from the front with respect to the direction of print head movement. At this time, since the air currents from the front are slower beneath the nozzle array in the rear, the satellite 022 of an ink droplet ejected from the rear nozzle array is hardly affected by the air current and the distance the satellite 022 is pushed backward is therefore reduced. The similar result is observed also in the relationship between the main droplet 021 and the satellite 022 on the print medium 013 when a backward direction printing is performed, as shown in FIG. 17B. That is, the distance b1' between the main droplet 021 and the satellite 022 of an ink droplet ejected from a nozzle array in the rear with respect to the direction of movement of the print head is greater than the distance a1' between the main droplet 021 and the satellite 022 of an ink droplet ejected from a nozzle array in front.

Here, as shown in FIG. 15B, the conventional inkjet print head 014 has the distance from its front end to a front nozzle array with respect to the direction of movement of the print head differ between the forward direction printing and the backward direction printing, and also has the distance from its rear end to a rear nozzle array differ between the forward direction printing and the backward direction printing. Let us take a cyan nozzle array 002 as an example and consider the distance from the front end of the print head and the nozzles of the cyan nozzle array. The distances to the front nozzles with respect to the direction of movement of the print head are $s1' \neq s1$ and those to the rear nozzles are $t1' \neq t1$. This means that the distance between the main droplet 021 and the satellite 022 formed on the print medium 013 differs between the forward direction printing and the backward direction printing. More precisely, in FIG. 17A and FIG. 17B, as for the distance to the front nozzle array with respect to the direction of movement of the print head, $b1 \neq a1'$; and as for the distance to the rear nozzle array with respect to the direction of movement of the print head, $a1 \neq b1'$.

What has been described above contributes to the problem with the conventional printing apparatus that the degree to which the surface of the print medium 013 is covered with dots differs between the forward direction printing and the backward direction printing, causing grayscale level variations in printed images and therefore uneven print quality.

SUMMARY OF THE INVENTION

It is therefore an object of this invention to provide an inkjet printing apparatus capable of printing images with no print quality variations.

This invention provides an inkjet printing apparatus capable of mounting a print head, the print head ejecting inks from a plurality of nozzle arrays onto a print medium, the print head comprising a moving means movable in a forward direction and in a backward direction and a print medium conveying means; wherein the plurality of nozzle arrays are arranged to cross a direction in which the moving means travels; wherein the plurality of nozzle arrays are formed integral as one unit and include a first nozzle array and a second nozzle array both ejecting the same color ink; wherein the first nozzle array and the second nozzle array are arranged at positions such that a fluid viscosity resistance between the print head and the print medium beneath the first nozzle array which occurs as the moving means moves in the forward direction is almost equal to a fluid viscosity resistance between the print head and the print medium beneath the second nozzle array which occurs as the moving means moves in the backward direction.

This invention also provides an inkjet printing apparatus capable of mounting a print head, the print head ejecting inks from a nozzle array onto a print medium, the print head comprising a moving means movable in a forward direction and in a backward direction and a print medium conveying means; wherein the nozzle array is those that eject inks of the same color and which are arranged to cross a direction in which the moving means travels; wherein the nozzle array is a single nozzle array or a plurality of nozzle arrays formed integral as one unit; wherein the fluid viscosity resistance between the print head and the print medium beneath the nozzle array changes between the forward direction and the backward direction in which the moving means travels; wherein, during a color printing, when the moving means moves in whichever direction has a greater fluid viscosity resistance—a fluid viscosity resistance between the print head and the print medium beneath a nozzle array situated at the front end of the nozzle array as the moving means moves in the forward direction or a fluid viscosity resistance beneath a nozzle array situated at the front end of the nozzle array as the moving means moves in the backward direction—it moves faster than when it moves in a direction in which the fluid viscosity resistance is smaller.

In the inkjet printing apparatus according to this invention, a plurality of nozzle arrays are arranged to cross a direction in which the moving means travels; and the plurality of nozzle arrays are formed integral as one unit and include a first nozzle array and a second nozzle array both ejecting the same color ink. The first nozzle array and the second nozzle array are arranged at positions such that a fluid viscosity resistance between the print head and the print medium beneath the first nozzle array which occurs as the moving means moves in the forward direction is almost equal to a fluid viscosity resistance beneath the second nozzle array which occurs as the moving means moves in the backward direction. This arrangement realizes an inkjet printing apparatus capable of printing images without print quality variations.

Further features of the present invention will become apparent from the following description of exemplary embodiments (with reference to the attached drawings).

DESCRIPTION OF THE EMBODIMENTS (First Embodiment)

Figure 5A:
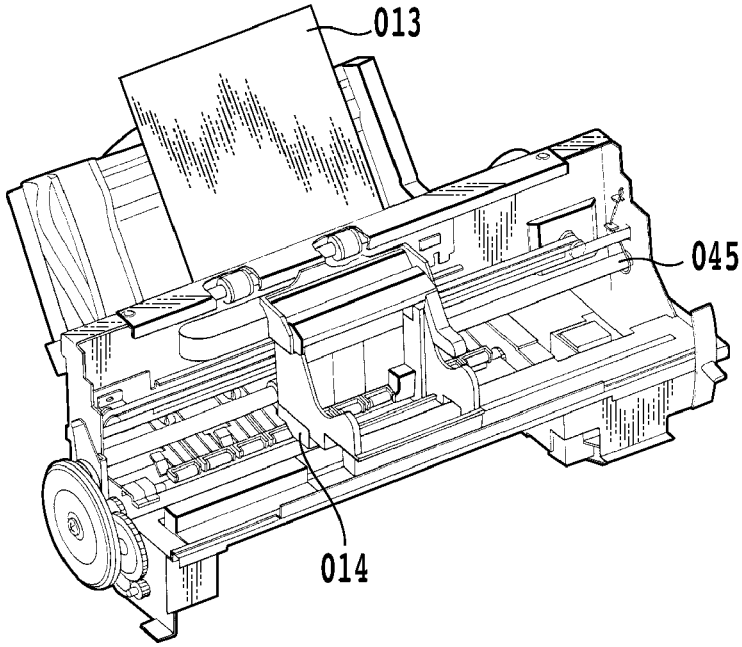
FIG. 5A is a perspective view showing the inkjet printing apparatus of the first embodiment and the print head used in the apparatus.
Figure 5B:
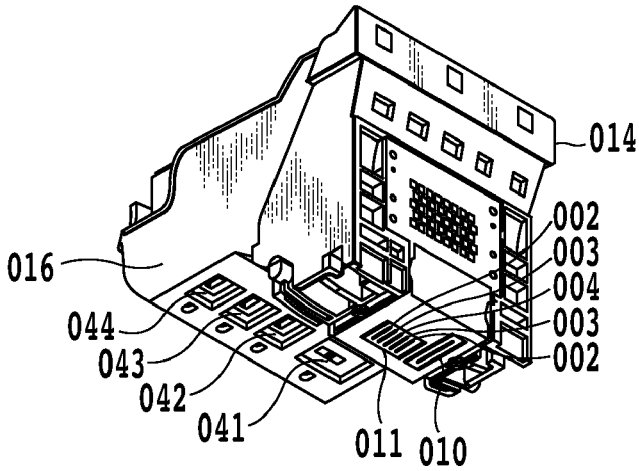
FIG. 5B is a perspective view of the print head used in the inkjet printing apparatus of the first embodiment.
Figure 5C:
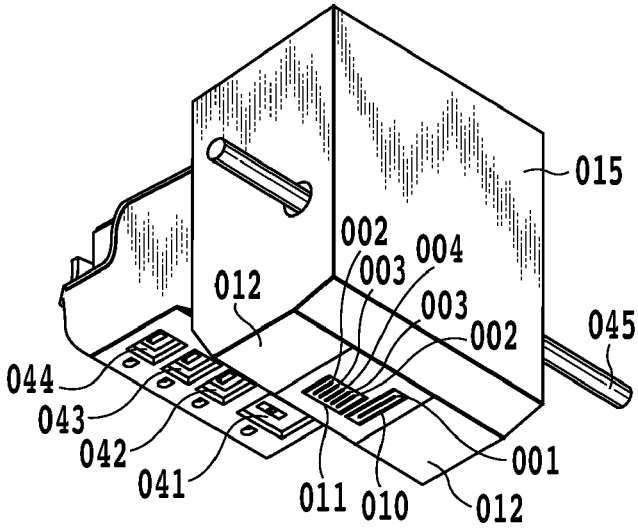
FIG. 5C is a perspective view of the print head used in the inkjet printing apparatus of the first embodiment.

A first embodiment of this invention will be described by referring to the accompanying drawings. FIG. 5A to FIG. 5C are perspective views showing internal constructions of an inkjet printing apparatus (or simply printing apparatus) of this embodiment and of a print head used in the printing apparatus. A print head 014 has an ink cartridge 016 that is removably mounted in a carriage 015. The printing apparatus also has a paper conveying means not shown for feeding a print medium 013. The print head 014 has a color chip 011 for ejecting color inks and a black chip 010 for ejecting a black ink, separated from each other.

The color chip 011 has a plurality of nozzle arrays—a cyan nozzle array 002, a magenta nozzle array 003 and a yellow nozzle array 004—formed integral as one unit. These nozzle arrays communicate with a cyan ink tank 042, a magenta ink tank 043 and a yellow ink tank 044 for ink supply. These nozzle arrays are arranged laterally symmetrical. More specifically, the magenta nozzle array 003 and the cyan nozzle array 002 respectively have two nozzle arrays—a first nozzle array and a second nozzle array—arranged laterally symmetric with the yellow nozzle array 004 placed at the center. With the same color nozzle arrays arranged laterally symmetrical, when the print head 014 is scanned over the print medium 013 in a direction crossing the print medium conveying direction, the order in which the color ink droplets land on the print medium 013 can be kept the same no matter in which direction, forward or backward, the print head scans.

The black chip 010 has a black nozzle array 001, which is connected to a black ink tank 041 through an ink path not shown for ink supply. Nozzles in the black nozzle array 001 are each provided with a heater not shown, which is energized by an externally supplied electric signal to heat the ink and produce a bubble in it to expel an ink droplet. The carriage 015 has a carriage shaft 045 piercing therethrough so that it can be moved in the forward and backward direction along the carriage shaft 045 in the printing apparatus. When the print head 014 is operated, it is moved back and forth along the carriage shaft 045. On the left and right side of the black chip 010 and the color chip 011 there are provided paper jam prevention plates 012 which protect nozzle arrays from being broken in the event that the print medium 013 unexpectedly gets twisted or corrugated.

Figure 1A:
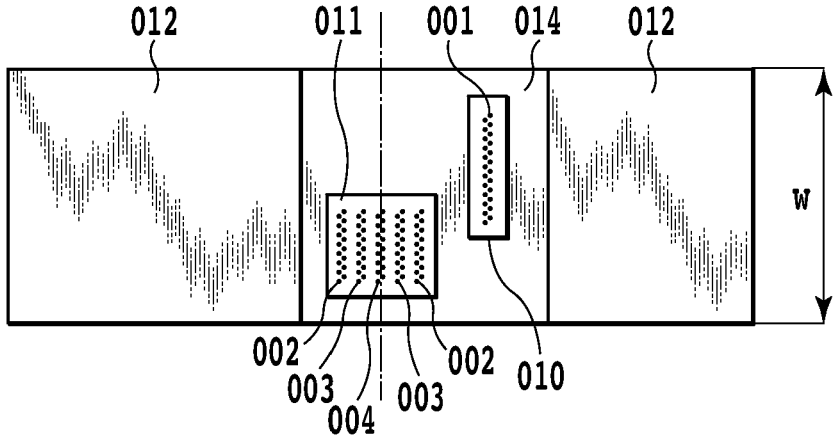
FIG. 1A is a front view showing a print head of a first embodiment.
Figure 1B:
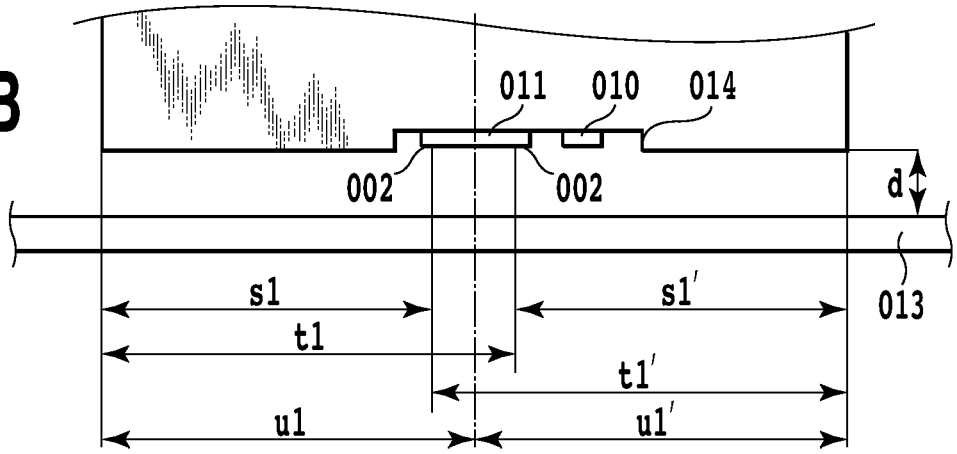
FIG. 1B is a side view showing a print head of the first embodiment.

FIG. 1A and FIG. 1B show a print head of this embodiment, FIG. 1A being a front view, FIG. 1B a side view. The present invention is characterized in that the magenta nozzle arrays 003 and cyan nozzle arrays 002 are arranged at equal intervals on both sides of the yellow nozzle array 004 as a center nozzle array and that a center line of the yellow nozzle array 004 lies at the center between the left and right end of the print head 014, i.e., a center of the two magenta nozzle arrays 003, one on each side of the yellow nozzle array 004, and a center of the two cyan nozzle arrays 002, one on each side of the yellow nozzle array 004, both lie at the center between the left and right end of the print head 014. This is how the yellow nozzle array, the magenta nozzle arrays (first magenta nozzle array and second magenta nozzle array) and the cyan nozzle arrays (first cyan nozzle array and second cyan nozzle array) are arranged. This arrangement enables the cyan, magenta and yellow color dots to be formed in the same way whether the print head is performing the forward direction printing or backward direction printing. This is explained in more detail by taking up the cyan nozzle array 002 as an example.

Figure 2A:
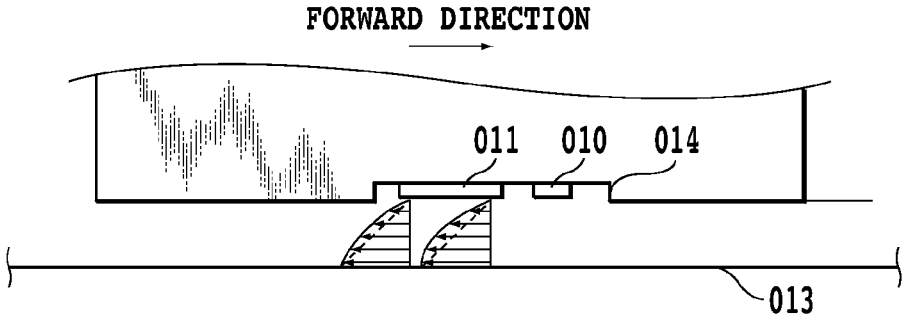
FIG. 2A shows a print head applicable to the printing apparatus of the first embodiment.
Figure 2B:
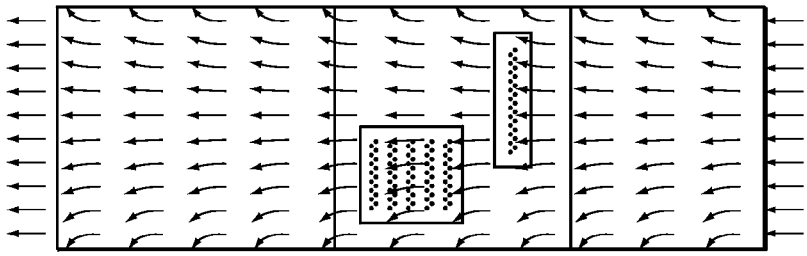
FIG. 2B shows a print head applicable to the printing apparatus of the first embodiment.
Figure 2C:
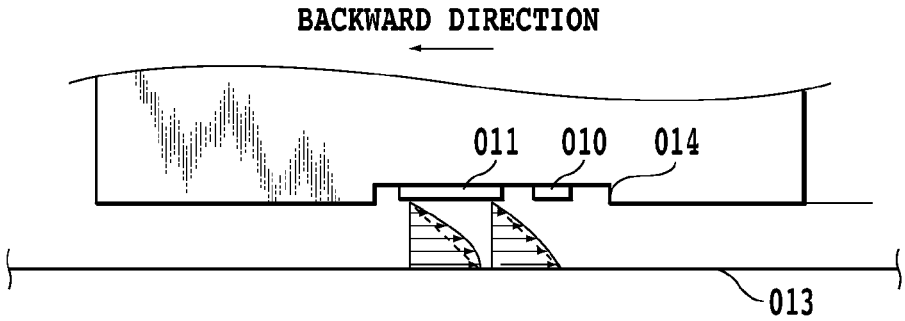
FIG. 2C shows a print head applicable to the printing apparatus of the first embodiment.
Figure 2D:
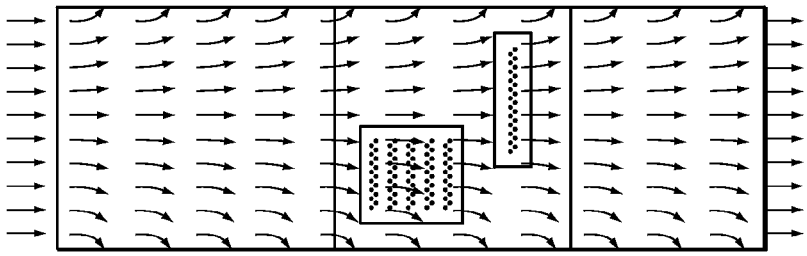
FIG. 2D shows a print head applicable to the printing apparatus of the first embodiment.

FIG. 2A to FIG. 2D show a print head applicable to the printing apparatus of this embodiment, FIG. 2A and FIG. 2B being a side view and a front view of the print head during the forward direction printing, FIG. 2C and FIG. 2D being a side view and a front view of the print head during the backward direction printing. As shown in FIG. 2A and FIG. 2C, a velocity of air current flowing from the front beneath a rear nozzle is slower than that beneath a front nozzle with respect to the direction of movement of the print head. This is the same as the conventional inkjet print head.

Figure 3A:
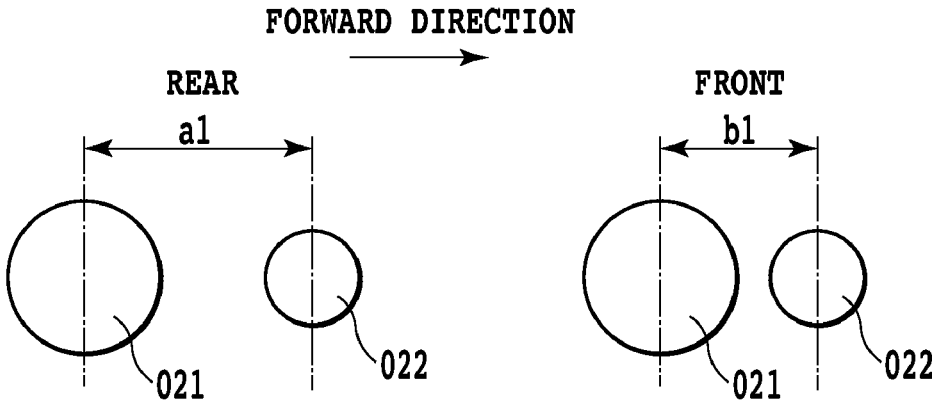
FIG. 3A shows a main droplet and a satellite that have landed on a print medium during the printing operation by the printing apparatus of the first embodiment.
Figure 3B:
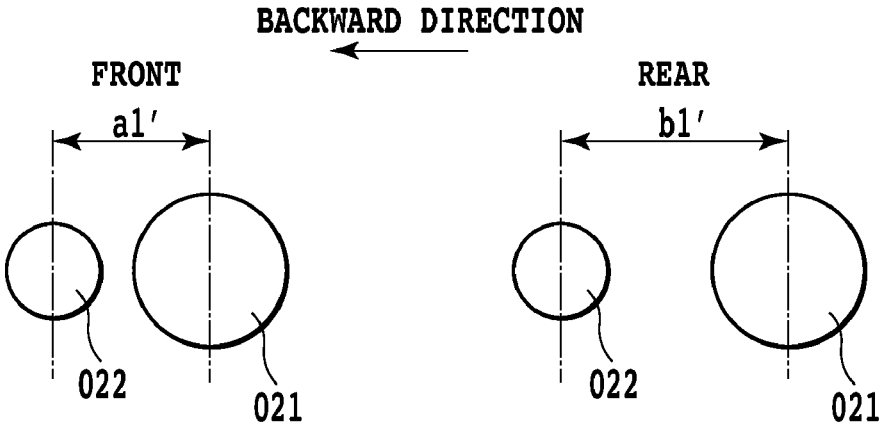
FIG. 3B shows a main droplet and a satellite that have landed on a print medium during the printing operation by the printing apparatus of the first embodiment.

FIG. 3A and FIG. 3B show a main droplet and a satellite that have landed on the print medium 013 when a printing operation is done by the printing apparatus of this embodiment. FIG. 3A is a schematic diagram when the forward direction printing is performed and FIG. 3B a schematic diagram for the backward direction printing. Since the air current beneath the front nozzle array with respect to the direction of movement of the print head differs from that beneath the rear nozzle array, the distance between the main droplet 021 and satellite 022 of an ink droplet ejected from the front nozzle array differs from that for an ink droplet ejected from the rear nozzle array ($a1 \neq b1$, $a1' \neq b1'$).

Figure 4:
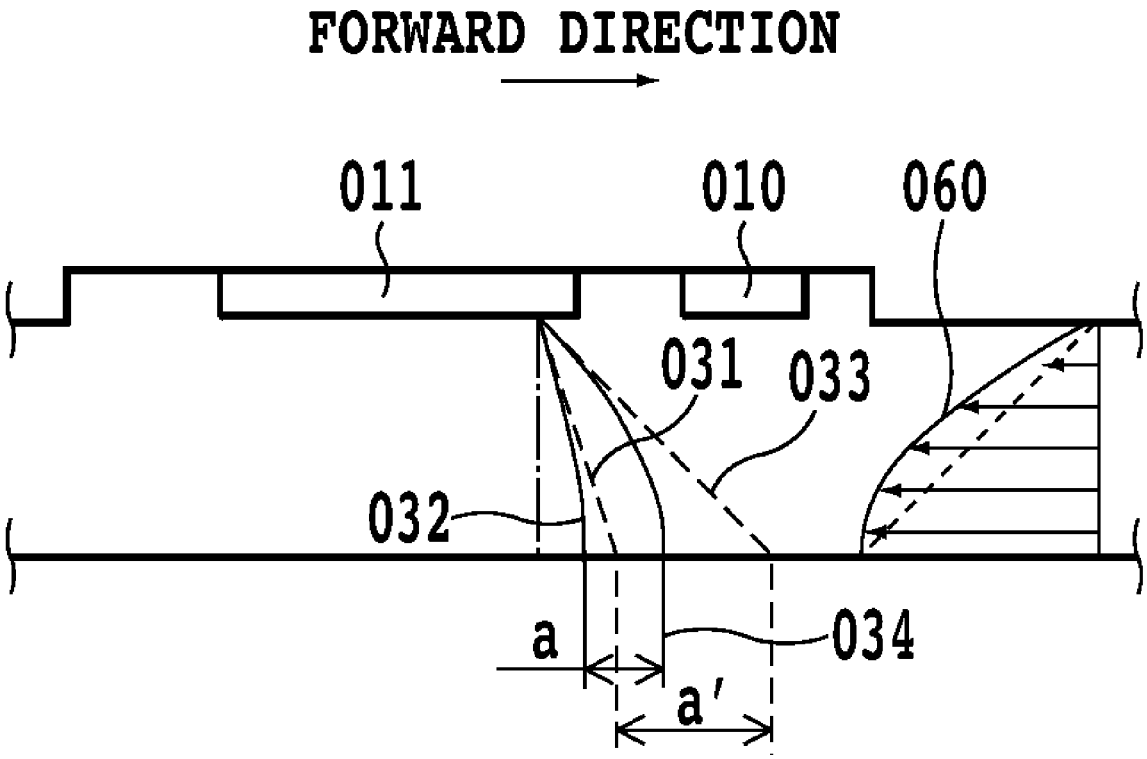
FIG. 4 shows landing positions of a main droplet and a satellite ejected from the print head of the printing apparatus of the first embodiment.

FIG. 4 shows landing positions of a main droplet 021 and a satellite 022 ejected from the print head 014 of the printing apparatus of this embodiment. Here why the distance between the main droplet 021 and the satellite 022 changes according to the strength of air current flowing from the front will be briefly explained by referring to FIG. 4. The explanation will show loci of the main droplet and satellite when ink is ejected from the front nozzle array of the cyan nozzle arrays 002 as the print head 014 moves in the forward direction.

The inkjet print head 014 ejects ink almost vertically toward the print medium 013 as it moves to the right in the figure (forward direction) relative to the print medium 013. Since the ink droplet, immediately after being ejected, has a momentum toward right, the main droplet of the ejected ink droplet describes a locus 032. This locus 032 is close to a parabola because the main droplet is directly subjected to the air current from the front. If the ink was ejected in a vacuum, the main droplet would follow a locus 031 shown dotted in the figure. A satellite, on the other hand, is slower in ejection velocity than the main droplet, so it follows a locus 034 in the figure. If it was ejected in a vacuum, the satellite would describe a locus 033 shown dotted in the figure.

The satellite is slower in ejection velocity and smaller in diameter than the main droplet and thus is more easily affected by the air current from the front. Therefore, if there is no air current from the front as in a vacuum, a landing position difference between the main droplet and the satellite would be a distance a' in FIG. 4. In reality, however, there is an air current from the front, so the landing position difference is a distance a (a<a').

Similarly also in the backward direction printing, because of the influence of the air current from the front, the distance a1' between the main droplet 021 and the satellite 022 ejected from the front nozzle array with respect to the direction of movement of the print head is smaller than the distance b1' between the main droplet 021 and the satellite 022 ejected from the rear nozzle array. The landing positions of the main droplet and satellite are as shown in FIG. 3B.

This invention makes a provision to make the distance from the front end of the print head 014 to the front nozzle array with respect to the direction of movement of the print head and the distance from the front end of the print head 014 to the rear nozzle array in the forward direction printing equal to those of the backward direction printing (s1=s1' and t1=t1' in FIG. 1B). This has enabled fluid viscosity resistances between the print head and the print medium over distances from the front end of the print head to the respective nozzle arrays to remain unchanged between the forward and backward direction printing (a1=b1' and a1'=b1 in FIG. 3A and FIG. 3B). As a result, a difference in the distance between the forward and backward direction printing is eliminated and images with no uneven print quality can be obtained even if an odd-numbered-pass printing is done.

In this embodiment, the black nozzle array 001 is placed at a position off-centered from the inkjet print head 014 and unsymmetrical with respect to the forward and backward direction. In the inkjet printing apparatus with such a print head construction, this black nozzle array 001 is normally provided to raise throughput of plain paper printing and usually ejects ink droplets of 30 pl or larger. It is added here that such a large ink droplet is relatively little affected by the air current, so in most cases the black nozzle array practically requires no such measures taken for the color nozzle arrays.

As described above, the color nozzle arrays are arranged symmetrical in the color chip so that the distances from the front end of the print head to the front and rear nozzle arrays in the forward direction printing are equal to those of the backward direction printing. This arrangement makes the fluid viscosity resistances beneath the respective nozzle arrays (the first nozzle array and the second nozzle array) between the print head and the print medium in the forward direction printing almost equal to those of the backward direction printing. This in turn has enabled almost uniform printing to be performed in both the forward direction and the backward direction, realizing an inkjet printing apparatus capable of printing images with no print quality variations.

(Second Embodiment)

A second embodiment of this invention will be described by referring to the accompanying drawings. The basic construction of this embodiment is similar to the first embodiment and its explanation is omitted. In the following only characteristic aspects of the construction will be explained.

Figure 6A:
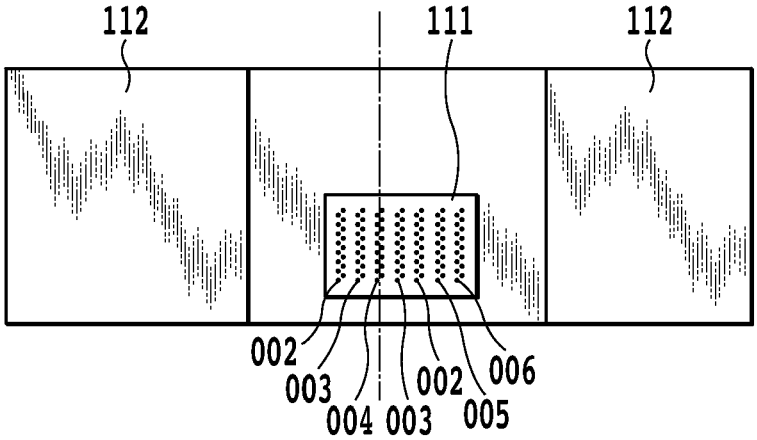
FIG. 6A is a front view of a print head of a second embodiment.
Figure 6B:
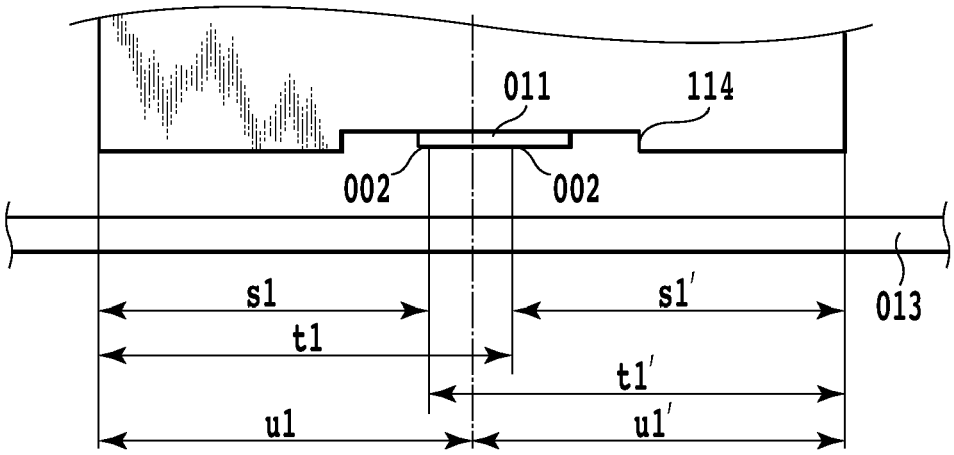
FIG. 6B is a side view of the print head of the second embodiment.

FIG. 6A and FIG. 6B show a print head of this embodiment, FIG. 6A being a front view and FIG. 6B a side view. A color chip 111 mounted on the print head 114 of this embodiment has, as in the first embodiment, a yellow nozzle array 004, magenta nozzle arrays 003 and cyan nozzle arrays 002. The color chip 111 also has a photo black nozzle array 005 and a red nozzle array 006 (these two nozzle arrays are called third nozzle arrays). In this embodiment, the cyan nozzle arrays 002 and the magenta nozzle arrays 003 are arranged laterally symmetrically with the yellow nozzle array 004 at the center. The photo black nozzle array 005 and red nozzle array 006 are arranged on one side only. In such a construction, the photo black nozzle array 005 is used where a dot coverage rate on an image being printed is extremely high, and thus has a high print frequency. Conversely, the red nozzle array 006, that ejects a characteristic ink, has an extremely low print frequency. This means that the photo black nozzle array 005 and the red nozzle array 006 do not have to be arranged laterally symmetrically with respect to the color chip 111, as they are in the first embodiment, to prevent print quality variations from appearing in the printed image.

With the yellow nozzle array, magenta nozzle arrays and cyan nozzle arrays arranged symmetrical with respect to the color chip as described above, the fluid viscosity resistance between the print head and the print medium over distances from the front end of the print head to the respective nozzle arrays can be made to remain unchanged between the forward direction printing and the backward direction printing. As for the photo black nozzle array and the red nozzle array, they are arranged unsymmetrical with respect to the color chip. That is, these two nozzle arrays are arranged so that the fluid viscosity resistance beneath the photo black nozzle array and the red nozzle array (beneath the third nozzle arrays) in the forward direction printing differs from that of the backward direction printing. This arrangement has enabled almost uniform printing to be performed in both the forward direction and the backward direction, realizing an inkjet printing apparatus capable of printing images with no print quality variations.

(Variation 1)

Figure 7A:
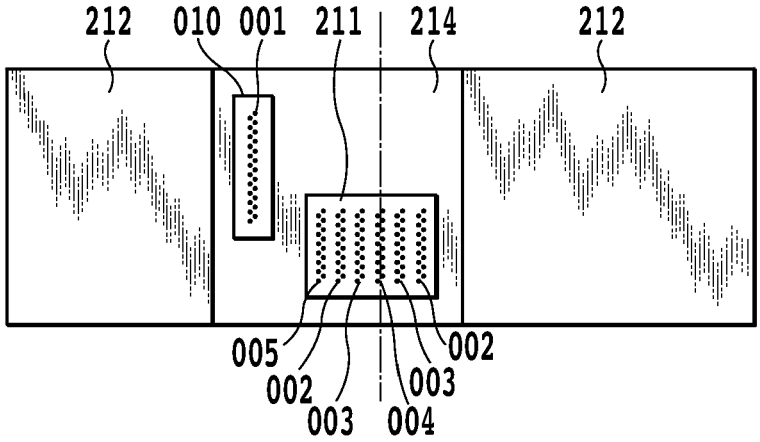
FIG. 7A is a front view of a variation of the print head of the second embodiment.
Figure 7B:
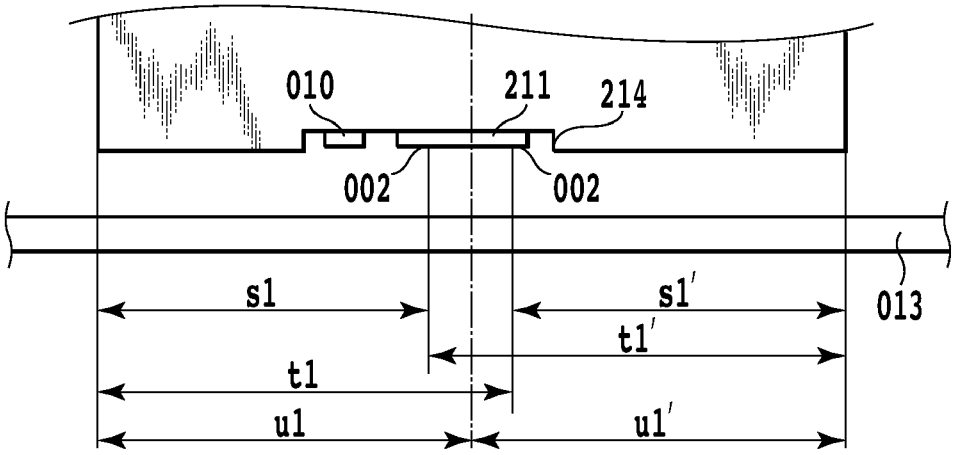
FIG. 7B is a side view of the variation of the print head of the second embodiment.

FIG. 7A and FIG. 7B show a print head as a variation of this embodiment, FIG. 7A being a front view and FIG. 7B a side view. A print head 214 as one variation has a black chip 010 in addition to a color chip 211, as in the first embodiment. The color chip 211 has, from left to right in the figure, a photo black nozzle array 005, a cyan nozzle array 002, a magenta nozzle array 003, a yellow nozzle array 004, a magenta nozzle array 003 and a cyan nozzle array 002. The cyan nozzle arrays 002 and the magenta nozzle arrays 003 are arranged symmetrical with the yellow nozzle array 004 at the center. Their symmetric plane matches the center of the print head 214 (u1=u1').

(Variation 2)

Figure 8A:
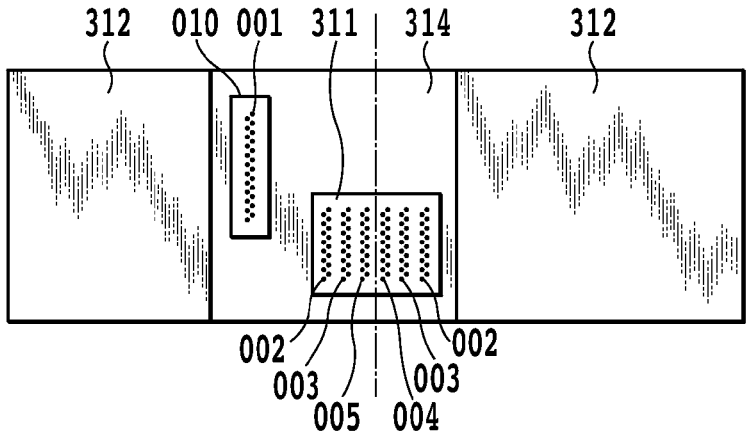
FIG. 8A is a front view of another variation of the print head of the second embodiment.
Figure 8B:
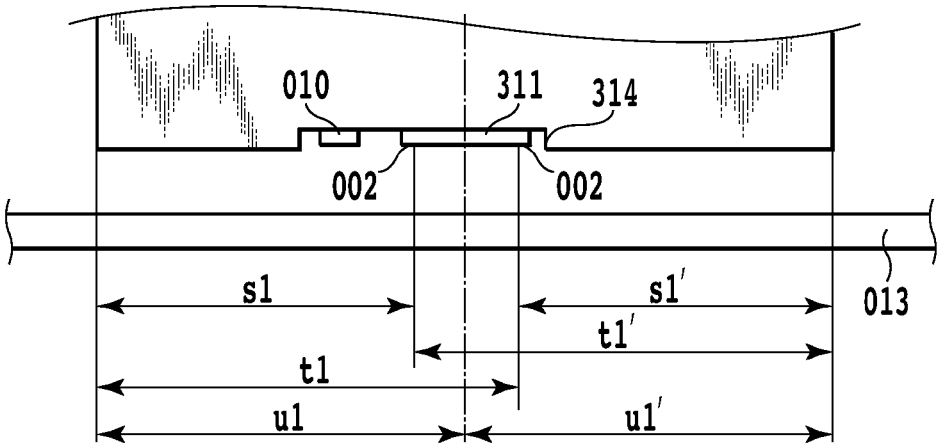
FIG. 8B is a side view of the another variation of the print head of the second embodiment.

FIG. 8A and FIG. 8B show a print head as another variation of this embodiment, FIG. 8A being a front view and FIG. 8B a side view. A print head 314 as one variation has a black chip 010 in addition to a color chip 311, as in the variation 1. Arranged on the color chip 311 are, from left to right in the figure, a cyan nozzle array 002, a magenta nozzle array 003, a photo black nozzle array 005, a yellow nozzle array 004, a magenta nozzle array 003 and a cyan nozzle array 002. In this example also, the cyan nozzle arrays 002 and the magenta nozzle arrays 003 are arranged laterally symmetric, and their symmetric plane patches the center of the print head 314.

(Variation 3)

Figure 9A:
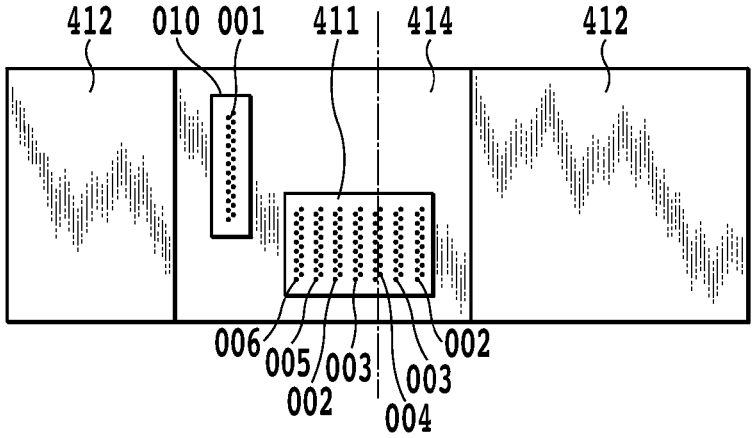
FIG. 9A is a front view of still another variation of the print head of the second embodiment.
Figure 9B:
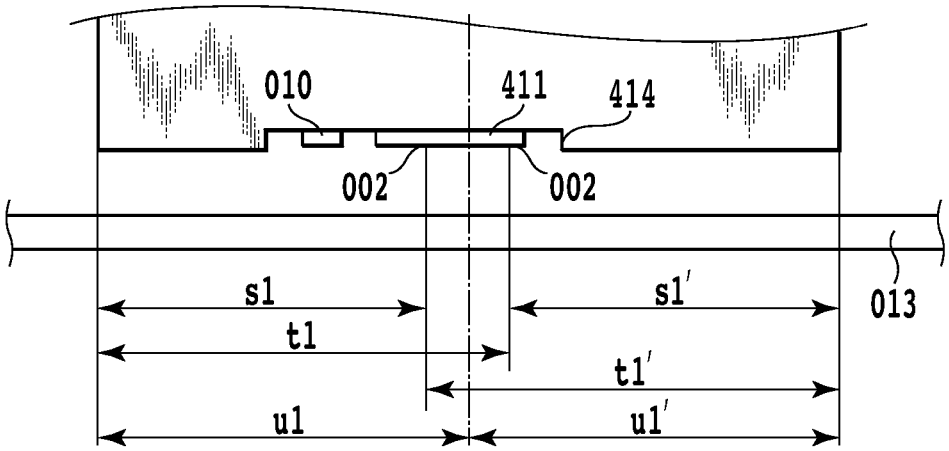
FIG. 9B is a side view of the still another variation of the print head of the second embodiment.

FIG. 9A and FIG. 9B show a print head as still another variation of this embodiment, FIG. 9A being a front view and FIG. 9B a side view. Although this example resembles variation 1, a color chip 411 of this example has a red nozzle array 006, that ejects a characteristic color, added to the color chip 211 of variation 1. The red nozzle array 006 is placed on the end side of the color chip 411, adjacent to the photo black nozzle array 005 of the color chip 211. It should also be noted that this red nozzle array 006, like photo black nozzle array 005, is provided, not symmetrically with respect to the color chip 411, but only on one side of the color chip 411. In other respects, the construction is similar to variation 1.

(Variation 4)

Figure 10A:
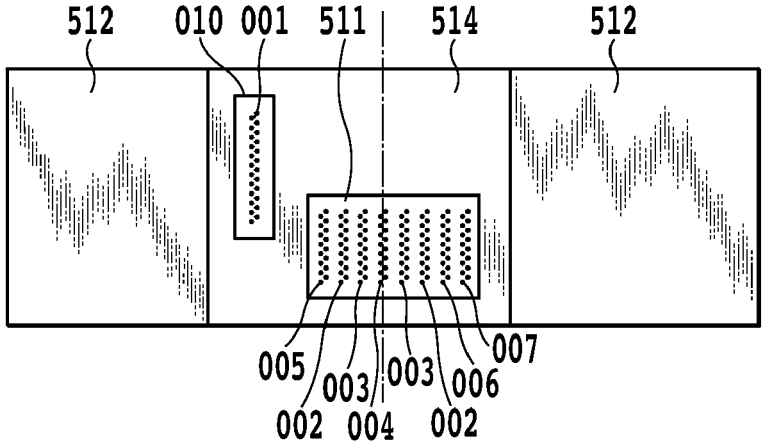
FIG. 10A is a front view of a further variation of the print head of the second embodiment.
Figure 10B:
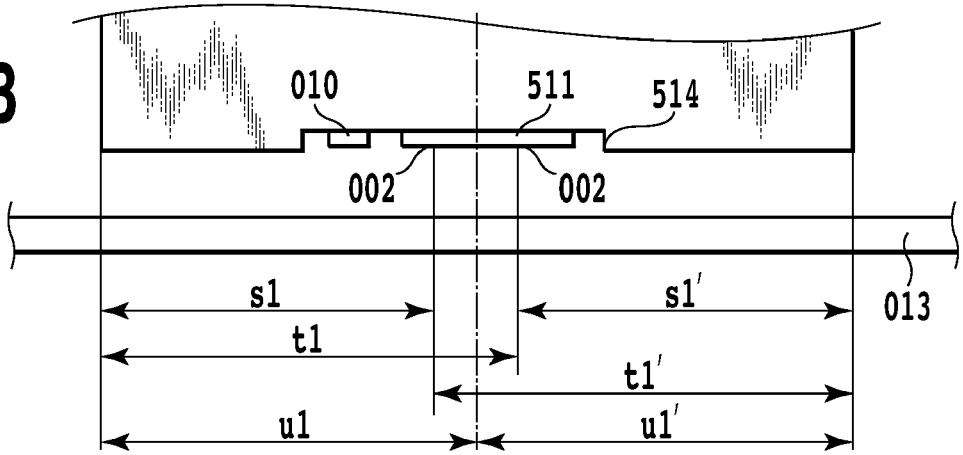
FIG. 10B is a side view of the further variation of the print head of the second embodiment.

FIG. 10A and FIG. 10B show a print head as a further variation of this embodiment, FIG. 10A being a front view and FIG. 10B a side view. The print head of this example has another characteristic color nozzle array, a green nozzle array 007, added to the color chip 411 of variation 3. Arranged on a color chip 511 are a photo black nozzle array 005, a cyan nozzle array 002, a magenta nozzle array 003, a yellow nozzle array 004, a magenta nozzle array 003, a cyan nozzle array 002, a red nozzle array 006 and a green nozzle array 007. In this example, too, the cyan nozzle arrays 002 and the magenta nozzle arrays 003, that both have a high frequency of operation and a high grayscale level, are arranged laterally symmetric, with their symmetric plane placed at the center of the print head 014.

As described in the above variations 1 to 4, even with various color nozzle arrays added, the print head has a basic construction in which the cyan nozzle arrays 002 and magenta nozzle arrays 003, both having a high frequency of operation and a high grayscale level, are arranged laterally symmetric, with their symmetric plane put at the center of the print head (014, 114, 214, 314, 414, 514). This arrangement allows almost the same printing to be performed in both the forward and backward printing operations, thus realizing an inkjet printing apparatus capable of printing images with no print quality variations.

This invention, of course, is not limited to the order of arrangement of color ink arrays.

(Third Embodiment)

A third embodiment of this invention will be described by referring to the accompanying drawings.

The basic construction of this embodiment is similar to the first embodiment and its explanation is omitted here. In the following only characteristic aspects of the construction will be explained.

Figure 11A:
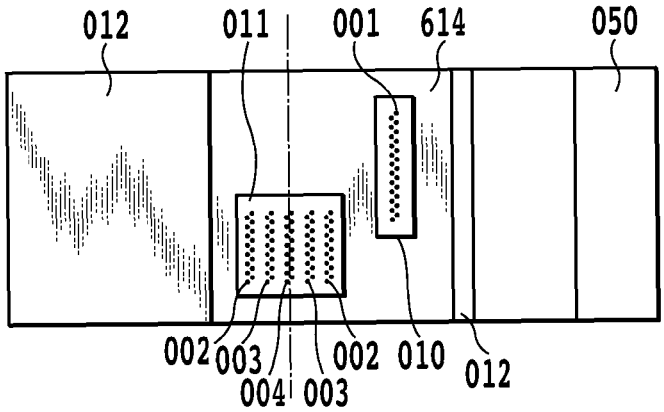
FIG. 11A is a front view of a print head of a third embodiment.
Figure 11B:
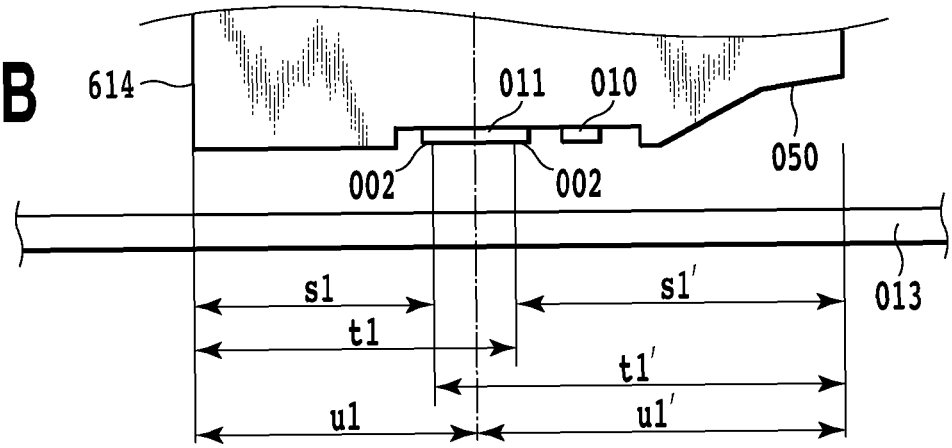
FIG. 11B is a side view of the print head of the third embodiment.

FIG. 11A and FIG. 11B show a print head of this embodiment, FIG. 11A being a front view and FIG. 11B a side view. The construction of a color chip and a black chip in this embodiment is similar to that of the conventional print head (see FIG. 15A and FIG. 15B). The point in which a print head 614 of this embodiment differs from the conventional print head is that a flow resistance reducing portion 050 is provided to the paper jam prevention plate 012 at one side of the inkjet print head 614.

Figure 12A:
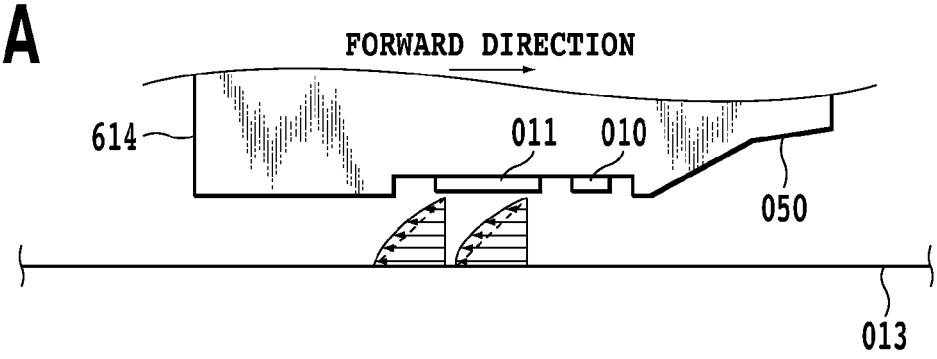
FIG. 12A shows a velocity of air current when the print head of the third embodiment is moving in the forward direction.
Figure 12B:
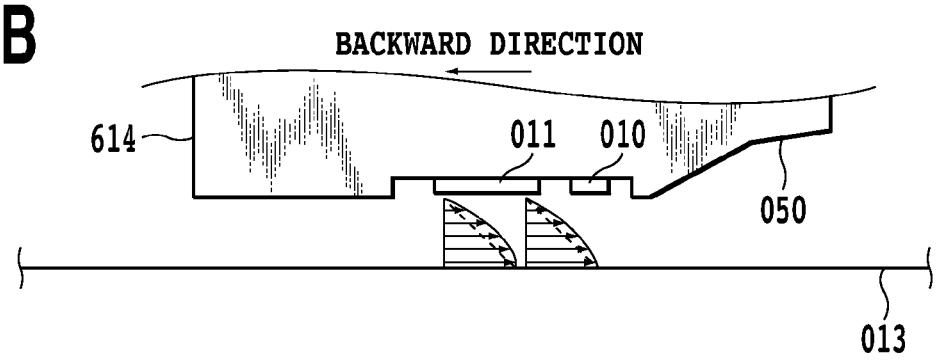
FIG. 12B shows a velocity of air current when the print head of the third embodiment is moving in the backward direction.

FIG. 12A and FIG. 12B show velocities of air current between the print head 614 and the print medium 013 when the print head of this embodiment is moving in the forward direction and in the backward direction, respectively. The provision of the flow resistance reducing portion 050 makes the air current velocities directly below the nozzle arrays in the forward direction printing almost equal to those in the backward direction printing despite the fact that the arrangement of the color chip 011 (arrangement of individual nozzle arrays) is not symmetric with respect to the forward and backward directions (u1≠u1' in FIG. 11B). With the flow resistance reducing portion 050 provided to the print head as described above, almost the same printing can be performed in both the forward and backward directions, thus realizing an inkjet printing apparatus capable of forming images with no print quality variations.

(Fourth Embodiment)

A fourth embodiment of this invention will be described by referring to the accompanying drawings. The basic construction of this embodiment is similar to that of the first embodiment and its explanation is omitted here. Only characteristic aspects of the construction will be explained.

Figure 13A:
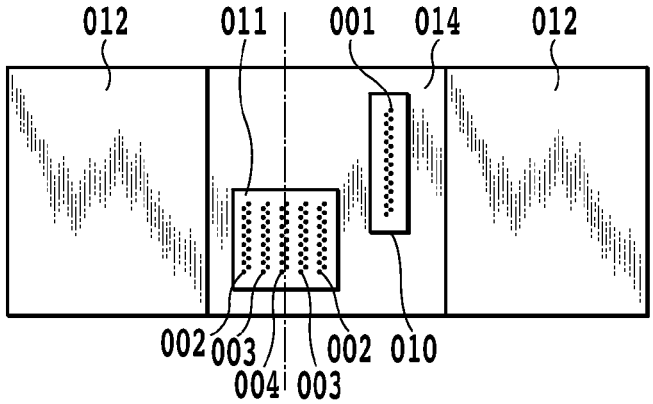
FIG. 13A is a front view of a print head of a fourth embodiment.
Figure 13B:
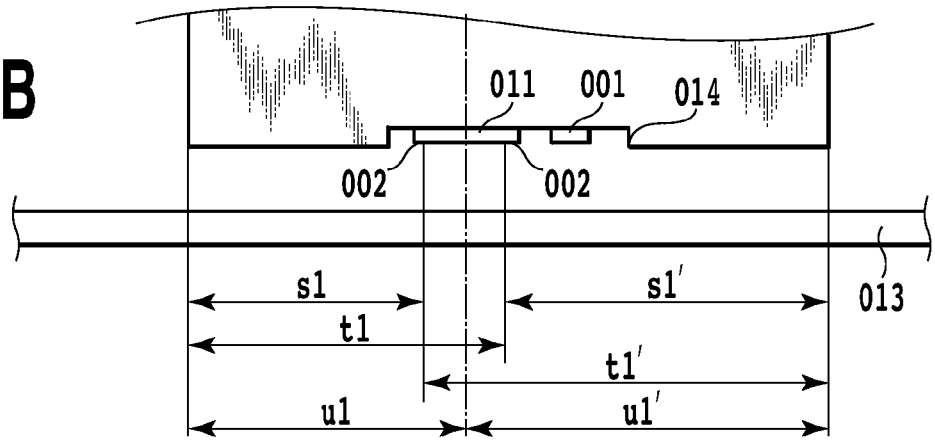
FIG. 13B is a side view of the print head of the fourth embodiment.
Figure 14A:
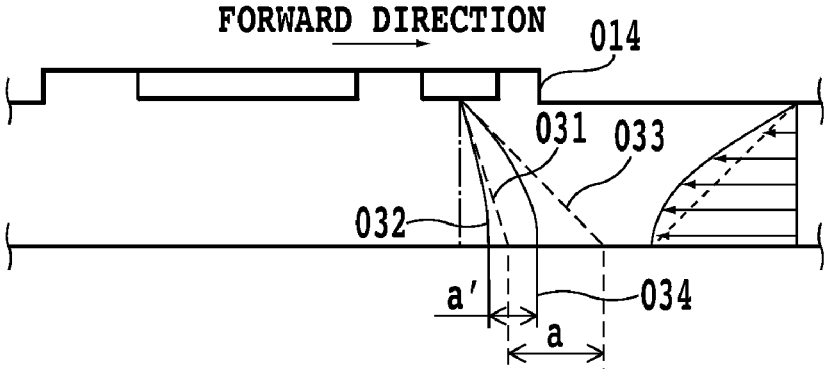
FIG. 14A shows a velocity of air current when the print head of the fourth embodiment is moving in the forward direction.
Figure 14B:
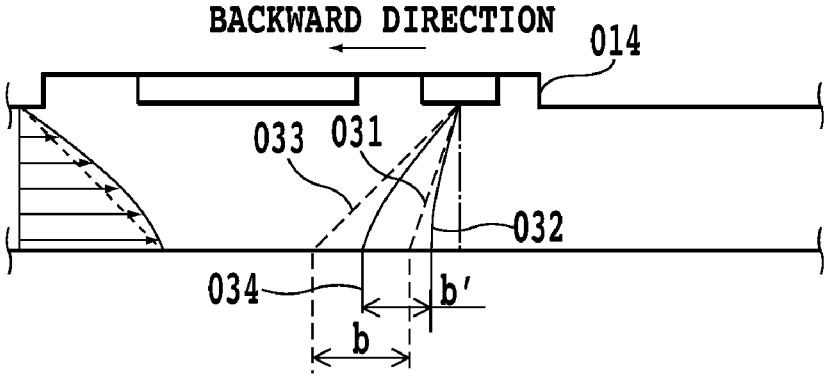
FIG. 14B shows a velocity of air current when the print head of the fourth embodiment is moving in the backward direction.
Figure 14C:
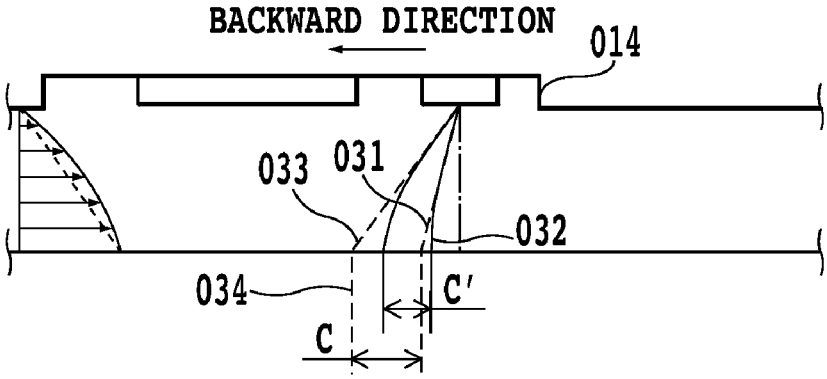
FIG. 14C shows a velocity of air current when the print head of the fourth embodiment is moving in the backward direction.

FIG. 13A and FIG. 13B show a print head of this embodiment, FIG. 13A being a front view and FIG. 13B a side view. FIG. 14A to FIG. 14C show velocities of air current between the print head and the print medium when the print head of this embodiment is moving in the forward and backward directions. The construction of the print head of this embodiment is similar to that of the print head 014 of the first embodiment. So, the print head in FIG. 13A to FIG. 13B and FIG. 14A to FIG. 14C uses the same reference numerals as those of the print head in FIG. 1A and FIG. 1B.

The point in which this embodiment differs from the first embodiment lies in the method of driving the black nozzle array 001. When the black nozzle array 001 in the above construction is driven, ink droplets ejected from the black nozzle array (fourth nozzle array) 001, when subjected to air current, can cause print quality variations in a printed image between the forward direction printing and the backward direction printing. In the first embodiment, it has been described that since the volume of ink droplets ejected from the black nozzle array 001 is normally large, an undesired effect the air current has on the ink droplets is small in practice. This embodiment seeks to eliminate even that small unwanted effect of air current. The means for this purpose is explained as follows.

The printing of color inks in this embodiment is exactly the same as that of the first embodiment, so its explanation is omitted here. If the print head 014 of such a construction as shown in FIG. 13 is used and scanned at the same speed in both the forward and backward directions by using only the black nozzle array 001, the air current velocity from the front changes between the forward and backward direction printing operations, as shown in FIG. 14A and FIG. 14B. That is, if the carriage travel speed remains the same in both the forward and backward directions, the fluid viscosity resistance beneath the black nozzle array (fourth nozzle array) changes between the forward direction printing and the backward direction printing.

This causes the main droplets and satellites to change their landing positions between the forward direction printing and the backward direction printing (a'≠b' in FIG. 14A and FIG. 14B). To deal with this problem, this embodiment, when performing a printing operation using only the black nozzle array 001 (monochromatic printing), makes the scan speed in the backward direction slower than that of the forward direction. As a result, the amount of shift of the main droplets and satellites from their intended landing positions remains unchanged between the forward direction printing and the backward direction printing.

During the monochromatic printing, changing the print head scan speed between the forward and backward directions as described above makes the landing position shifts of the main droplets and satellites that occur during the forward direction printing equal to those occurring during the backward direction printing (a'=c' in FIG. 14A and FIG. 14C), reducing print quality variations. This enables almost the same printing to be performed in both the forward direction printing and the backward direction printing, thus realizing an inkjet printing apparatus that can print images with no print quality variations.

(Fifth Embodiment)

Now, a fifth embodiment of this invention will be described by referring to the accompanying drawings. The basic construction of this embodiment is similar to that of the first embodiment and thus its explanation is omitted here. In the following only the characteristic aspects of construction will be explained.

Figure 15A:
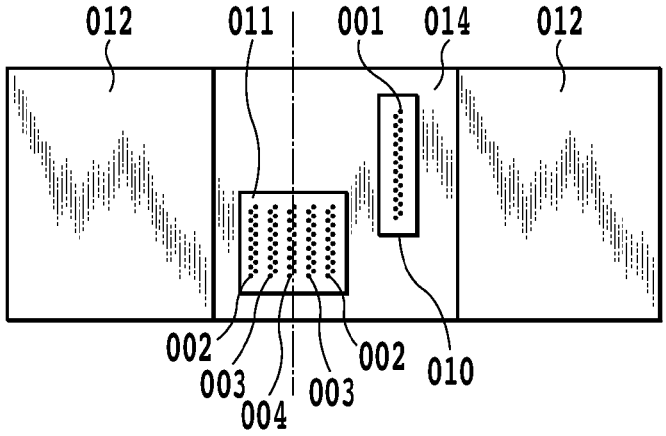
FIG. 15A is a front view of a conventional print head.
Figure 15B:
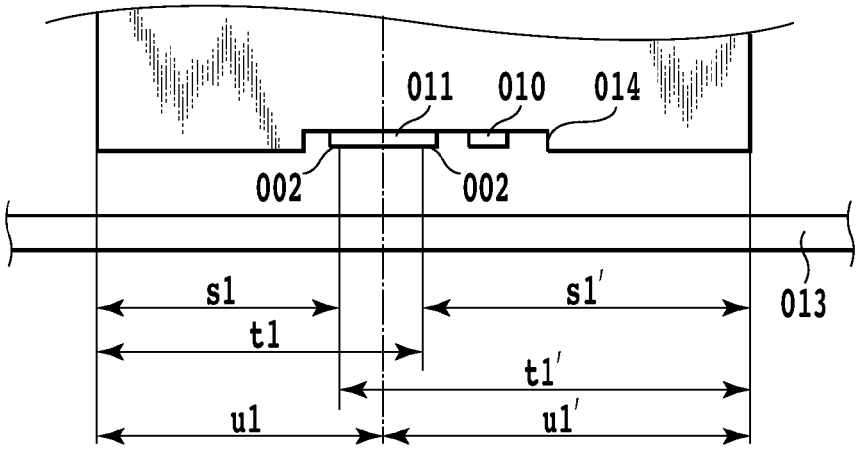
FIG. 15B is a side view of the conventional print head.
Figure 16A:
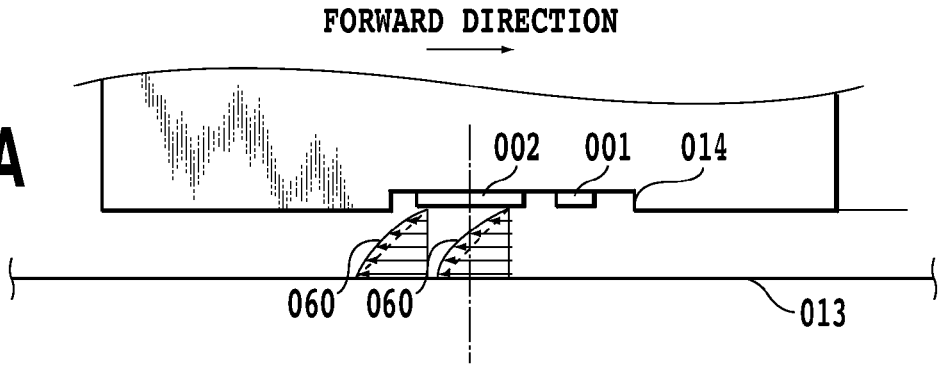
FIG. 16A is a side view of a conventional print head showing a state of air current produced between the print head and the print medium when the print head is moving in the forward direction.
Figure 16B:
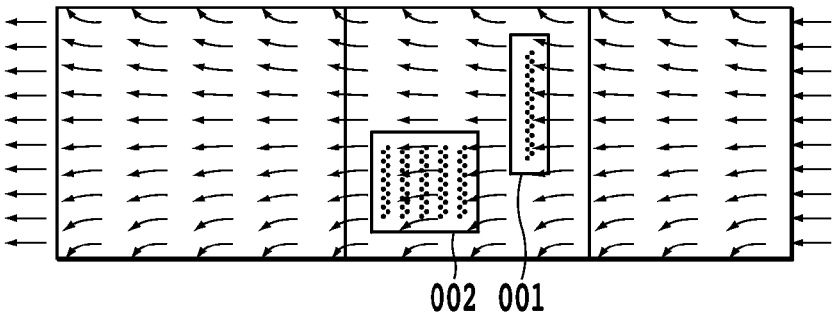
FIG. 16B is a front view of the conventional print head showing the state of air current produced between the print head and the print medium when the print head is moving in the forward direction.
Figure 16C:
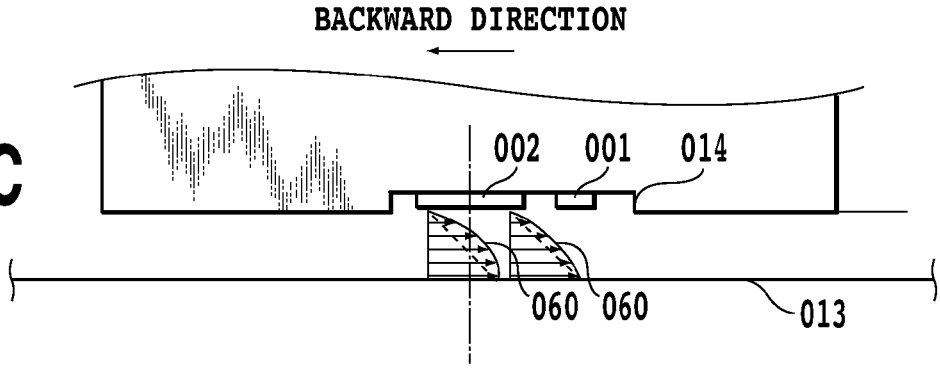
FIG. 16C is a side view of a conventional print head showing a state of air current produced between the print head and the print medium when the print head is moving in the backward direction.
Figure 16D:
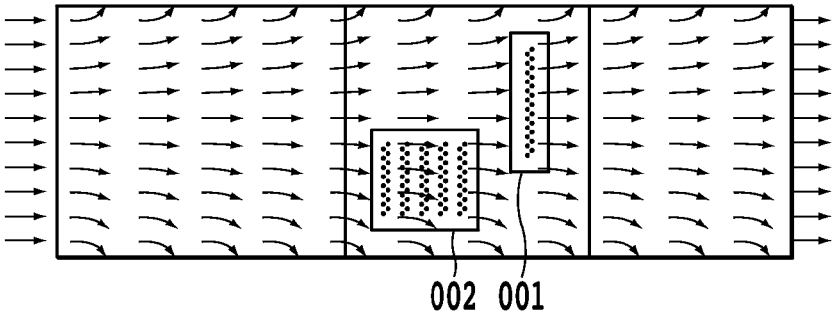
FIG. 16D is a front view of the conventional print head showing the state of air current produced between the print head and the print medium when the print head is moving in the backward direction.
Figure 17A:
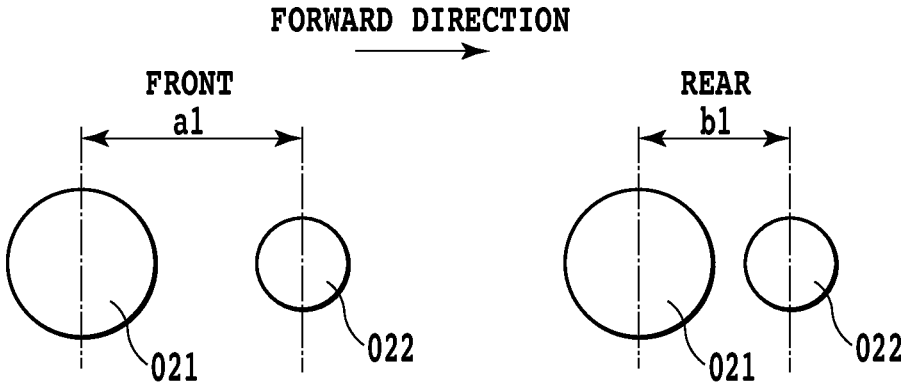
FIG. 17A is a schematic diagram showing landing positions of a main droplet and a satellite that have landed on a print medium during a forward direction printing.
Figure 17B:
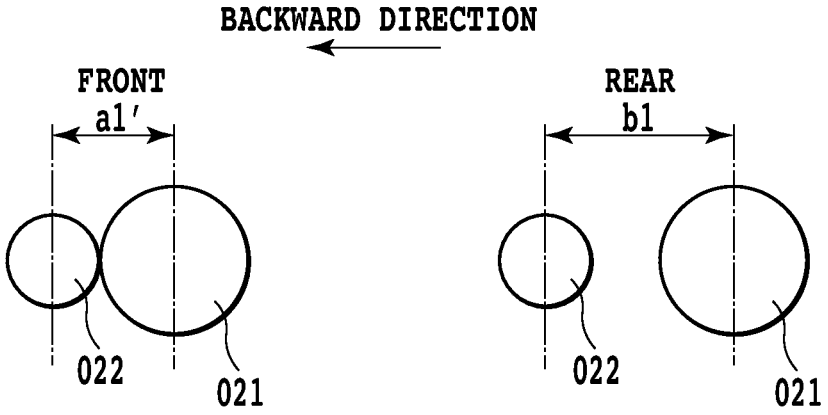
FIG. 17B is a schematic diagram showing landing positions of a main droplet and a satellite that have landed on a print medium during a backward direction printing.

The mechanical construction of the print head of this embodiment is identical with that of the conventional print head (see FIG. 15A and FIG. 15B). So, its explanation with reference to the drawings is not given here. The characteristic aspect of this embodiment is that, in the inkjet printing apparatus mounting the print head 014 of FIG. 15, the scan speed of the print head is changed between the forward and backward directions. More specifically, in a printing operation using the color chip 011, the print head is driven by setting the scan speed during the backward scan slower than that during the forward scan. This is because the color chip 011 is arranged at the front side of the print head 014 with respect to the backward direction. When the black chip 010 is used, the scan speed during the forward scan is set slower than that during the backward scan because the black chip 010 is located at the front side of the print head 014 with respect to the forward direction.

By changing the scan speed of the print head between the forward scan and the backward scan, the landing position shifts of the main droplets and satellites can be kept unchanged between the forward scan and the backward scan. This enables almost the same printing to be performed in both the forward scan and the backward scan, thus realizing an inkjet printing apparatus capable of printing images free from print quality variations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-139535, filed Jun. 10, 2009, which is hereby incorporated by reference herein in its entirety.

What is claimed is:

1. An inkjet printing apparatus capable of mounting a print head, the print head ejecting inks from a plurality of nozzle arrays onto a print medium, the printing apparatus comprising moving means effecting relative movement of the print head in a forward direction and in a backward direction and print medium conveying means, wherein the plurality of nozzle arrays are arranged to cross a moving direction in which the moving means effects the relative movement of the print head, wherein the plurality of nozzle arrays include a first nozzle array and a second nozzle array which are arranged to be parallel in the moving direction and both ejecting the same color ink, wherein the first nozzle array and the second nozzle array are arranged at positions such that a fluid viscosity resistance between the print head and the print medium beneath the first nozzle array which occurs as the moving means moves the print head in the forward direction is almost equal to a fluid viscosity resistance between the print head and the print medium beneath the second nozzle array which occurs as the moving means moves the print head in the backward direction, and wherein a distance from a front end of the print head to the first nozzle array as the print head moves in the forward direction is almost equal to a distance from the front end of the print head to the second nozzle array as the print head moves in the backward direction.

2. An inkjet printing apparatus according to claim 1, wherein each of the first nozzle array and the second nozzle array comprises a plurality of nozzle arrays, wherein the first nozzle array comprises a first cyan nozzle array for ejecting a cyan ink and a first magenta nozzle array for ejecting a magenta ink, and wherein the second nozzle array comprises a second cyan nozzle array for ejecting a cyan ink and a second magenta nozzle array for ejecting a magenta ink.

3. An inkjet printing apparatus according to claim 1, wherein the print head has, in addition to the first nozzle array and the second nozzle array, a third nozzle array formed integral with the first nozzle array and the second nozzle array and which ejects a color ink other than cyan and magenta inks, and wherein the third nozzle array is placed at a position such that a fluid viscosity resistance between the print head and the print medium beneath the third nozzle array assumes a value when the moving means moves the print head in the forward direction and another value different from the first value when the moving means moves the print head in the backward direction.

4. An inkjet printing apparatus according to claim 1, wherein the print head includes a third nozzle array that is formed separate from the first and the second nozzle arrays and which ejects ink of a color different from those of the first and the second nozzle arrays, wherein the third nozzle array is arranged at a position such that a fluid viscosity resistance between the print head and the print medium beneath the third nozzle array which occurs as the moving means moves the print head in the forward direction differs from a fluid viscosity resistance between the print head and the print medium beneath the third nozzle array which occurs as the moving means moves the print head in the backward direction, wherein, during color printing, moving speeds of the print head by the moving means in the forward direction and in the backward direction are equal, and wherein, during monochromatic printing, when the moving means moves the print head in whichever of the forward and backward directions has a greater fluid viscosity resistance beneath the third nozzle array, the moving means moves the print head faster than when the moving means moves the print head in a direction in which the fluid viscosity resistance beneath the third nozzle array is smaller.

5. An inkjet printing apparatus capable of mounting a print head, the print head ejecting inks from a plurality of nozzle arrays onto a print medium, the printing apparatus comprising moving means effecting relative movement of the print head in a forward direction and in a backward direction and print medium conveying means, wherein the plurality of nozzle arrays are arranged to cross a moving direction in which the moving means effects the relative movement of the print head, wherein the plurality of nozzle arrays include a first nozzle array and a second nozzle array which are arranged to be parallel in the moving direction and both ejecting the same color ink, wherein the first nozzle array and the second nozzle array are arranged at positions such that a fluid viscosity resistance between the print head and the print medium beneath the first nozzle array which occurs as the moving means moves the print head in the forward direction is almost equal to a fluid viscosity resistance between the print head and the print medium beneath the second nozzle array which occurs as the moving means moves the print head in the backward direction, wherein a distance from a front end of the print head to the first nozzle array as the print head moves in the forward direction is different from a distance from the front end of the print head to the second nozzle array as the print head moves in the backward direction, wherein the print head is provided with a flow resistance reducing portion, and wherein the provision of the flow resistance reducing portion makes the fluid viscosity resistance between the print head and the print medium beneath the first nozzle array which occurs as the moving means moves the print head in the forward direction almost equal to the fluid viscosity resistance between the print head and the print medium beneath the second nozzle array which occurs as the moving means moves the print head in the backward direction.

6. An inkjet printing apparatus capable of mounting a print head, the print head ejecting inks from a nozzle array onto a print medium, the printing apparatus comprising moving means effecting relative movement of the print head in a forward direction and in a backward direction and print medium conveying means, wherein the nozzle array ejects inks of the same color and is arranged to cross a moving direction in which the moving means effects the relative movement of the print head, wherein the nozzle array is a single nozzle array or a plurality of nozzle arrays formed integral as one unit, wherein the fluid viscosity resistance between the print head and the print medium beneath the nozzle array changes between the forward direction and the backward direction in which the moving means effects relative movement of the print head, and wherein, during color printing, when the moving means moves the print head in whichever direction has a greater fluid viscosity resistance among a fluid viscosity resistance between the print head and the print medium beneath nozzles situated at a front end of the nozzle array as the moving means moves the print head in the forward direction and a fluid viscosity resistance beneath nozzles situated at the front end of the nozzle array as the moving means moves the print head in the backward direction the moving means moves the print head faster than when the moving means moves the print head in a direction in which the fluid viscosity resistance is smaller.

7. An inkjet printing apparatus according to claim 6, wherein the nozzle array has a plurality of cyan nozzle arrays to eject cyan inks and a plurality of magenta nozzle arrays to eject magenta inks.

8. An inkjet printing apparatus according to claim 6, wherein the print head includes another nozzle array that is formed separate from the nozzle array and which ejects ink of a color different from that of the nozzle array, wherein the other nozzle array is arranged at a position such that a fluid viscosity resistance between the print head and the print medium beneath the other nozzle array which occurs as the moving means moves the print head in the forward direction differs from a fluid viscosity resistance between the print head and the print medium beneath the other nozzle array which occurs as the moving means moves the print head in the backward direction, and wherein, during monochromatic printing, when the moving means moves the print head in whichever of the forward and backward directions has a greater fluid viscosity resistance beneath the other nozzle array, the moving means moves the print head faster than when the moving means moves the print head in a direction in which the fluid viscosity resistance beneath the other nozzle array is smaller.

* * * * *